US009328636B2

(12) United States Patent
Kinouchi

(10) Patent No.: US 9,328,636 B2
(45) Date of Patent: May 3, 2016

(54) OIL PRESSURE CONTROL VALVE AND VALVE TIMING CONTROLLER

(71) Applicant: DENSO CORPORATION, Kariya, Aichi-pref. (JP)

(72) Inventor: Soichi Kinouchi, Kariya (JP)

(73) Assignee: DENSO CORPORATION, Kariya (JP)

( * ) Notice: Subject to any disclaimer, the term of this patent is extended or adjusted under 35 U.S.C. 154(b) by 28 days.

(21) Appl. No.: 14/563,019

(22) Filed: Dec. 8, 2014

(65) Prior Publication Data

US 2015/0167504 A1 Jun. 18, 2015

(30) Foreign Application Priority Data

Dec. 17, 2013 (JP) ..... 2013-260034
Oct. 22, 2014 (JP) ..... 2014-215179

(51) Int. Cl.
*F01L 9/02* (2006.01)
*F01L 1/34* (2006.01)
*F01L 1/344* (2006.01)

(52) U.S. Cl.
CPC ..... *F01L 1/34* (2013.01); *F01L 2001/34426* (2013.01); *Y10T 137/87169* (2015.04)

(58) Field of Classification Search
CPC ..... F01L 1/34; F01L 2001/34426; Y10T 137/87169
USPC ..... 123/90.12, 90.15, 90.17
See application file for complete search history.

(56) References Cited

U.S. PATENT DOCUMENTS 8,695,548 B2 * 4/2014 Kato ..... F01L 1/3442 123/90.15
2007/0095315 A1 5/2007 Hoppe et al.
2012/0145099 A1 6/2012 Kato et al.

FOREIGN PATENT DOCUMENTS

JP 2003-014146 1/2003

OTHER PUBLICATIONS

Office Action (2 pages) dated Dec. 1, 2015 issued in corresponding Japanese Application No. 2014-215179 and English translation (2 pages).

* cited by examiner

*Primary Examiner* — Ching Chang
(74) *Attorney, Agent, or Firm* — Nixon & Vanderhye PC

(57) ABSTRACT

A supply oil passage is defined in a sleeve and communicates to a feed port to which oil is supplied. A valve object is able to be seated on or separated from a valve seat defined on an inner wall of the supply oil passage. A guide wall is defined by an inner wall of the sleeve, and the valve seat is located between the feed port and the guide wall. A forward flow port extends from the guide wall to an oil passage of an attachment component. A pressure chamber is defined in the sleeve, and the valve seat is located between the supply oil passage and the pressure chamber. A backflow port always allows the pressure chamber and the oil passage of the attachment component to communicate with each other. The forward flow port is located between the valve seat and the backflow port.

10 Claims, 5 Drawing Sheets

OIL PRESSURE CONTROL VALVE AND VALVE TIMING CONTROLLER

CROSS REFERENCE TO RELATED APPLICATION

This application is based on Japanese Patent Application No. 2013-260034 filed on Dec. 17, 2013 and Japanese Patent Application No. 2014-215179 filed on Oct. 22, 2014, the disclosures of which are incorporated herein by reference in their entirety.

TECHNICAL FIELD

The present disclosure relates to an oil pressure control valve and a valve timing controller.

BACKGROUND

A valve timing controller controls opening-and-closing timing of an intake valve or an exhaust valve by changing a relative rotation phase between a crankshaft and a camshaft of an internal combustion engine for a vehicle. The intake valve or an exhaust valve is driven by the camshaft.

JP 2009-515090A (US 2007/0095315A) describes a valve timing controller in which a vane rotor is rotatable relative to a housing. The valve timing controller includes an oil pressure control valve at a rotation central part of the vane rotor and the camshaft. The oil pressure control valve controls oil passages so that oil is supplied from an oil pump to an advance chamber or a retard chamber defined in the housing. Thereby, the valve timing controller can control the relative rotation phase between the housing and the vane rotor.

A spring is provided for biasing the intake valve or exhaust valve in a valve-closing direction. While the valve timing controller carries out a phase control in a first direction, when torque acts on the camshaft from the spring in a second direction opposite from the first direction, oil may flow backwards from the advance chamber or retard chamber toward the oil pump. The oil pressure control valve of JP 2009-515090A has a valve seat defined by an inner wall of an oil passage to which oil is supplied from the oil pump, a ball valve seated on or separated from the valve seat, and a spring which biases the ball valve toward the valve seat. In case where oil flows backwards from the advance chamber or retard chamber toward the oil pump, when an oil pressure applied to the ball valve from a side of the oil pump becomes smaller than the force of the spring, the ball valve is seated on the valve seat. Thus, the backflow of oil and an unintentional movement of the vane rotor caused by the cam torque are prevented.

However, the valve-closing responsivity may be worse in the oil pressure control valve in case where the oil flows backwards, since the ball valve is seated on the valve seat by the elastic force of the spring.

Moreover, pressure loss may arise in oil flowing to the advance chamber or retard chamber when oil is supplied to the advance chamber or retard chamber from the oil pump, because the oil pressure is applied to the spring which biases the ball valve.

Furthermore, the number of components necessary for producing the oil pressure control valve is increased, and the structure of the oil pressure control valve becomes complicated, due to the spring which biases the ball valve.

SUMMARY

It is an object of the present disclosure to provide an oil pressure control valve with a simple structure to have high valve-closing responsivity at a time of backflow, and a valve timing controller equipped with the oil pressure control valve.

According to an aspect of the present disclosure, an oil pressure control valve to be attached to an attachment component having an oil passage includes a sleeve, a valve object, a guide wall, a forward flow port, a pressure chamber, and a backflow port. The sleeve has a cylindrical shape, and a supply oil passage is defined in the sleeve and communicates to a feed port to which oil is supplied. The valve object is able to be seated on or separated from a valve seat defined on an inner wall of the supply oil passage. The guide wall is defined by an inner wall of the sleeve. The valve object is able to slidingly move in contact with the guide wall. The valve seat is located between the feed port and the guide wall. The forward flow port extends from the guide wall to the oil passage of the attachment component. The pressure chamber is defined in the sleeve. The valve seat is located between the supply oil passage and the pressure chamber. The backflow port always allows the pressure chamber and the oil passage of the attachment component to communicate with each other. The forward flow port is located between the valve seat and the backflow port.

The valve object is movable by sliding on the guide wall. The forward flow port extends to the oil passage of the attachment component from the guide wall. The backflow port always allows the pressure chamber to communicate with the oil passage of the attachment component. The pressure chamber is arranged opposite from the supply oil passage through the valve object.

When oil is supplied to the supply oil passage from the feed port of the sleeve, the dynamic pressure of oil acts on the valve object, and the valve object is separated from the valve seat. Therefore, oil flows into the forward flow port from the supply oil passage, and this flow of oil is hereafter called as forward flow. At this time, oil flowing into the backflow port that is connected to the forward flow port does not affect the movement of the valve object, because pressure loss arises at the bent part of the oil passage.

In case where oil flows from the oil passage of the attachment component in a direction opposite from the forward flow (this flow of oil is hereafter called as backflow), oil is introduced into the backflow port and the forward flow port. At this time, the valve object is pressurized toward the valve seat by the dynamic pressure of oil introduced into the pressure chamber from the backflow port. On the other hand, when oil introduced into the forward flow port flows between the valve object and the valve seat, the oil pressure is lowered according to the flow velocity. Therefore, the valve object is seated on the valve seat, and the flow of oil is intercepted. Thus, when a backflow arises, the valve object is seated onto the valve seat by the oil pressure introduced into the backflow port and the forward flow port in the oil pressure control valve. Accordingly, the valve-closing responsivity can be raised.

Moreover, the oil pressure control valve has no spring that biases the valve object to the valve seat. Therefore, when a forward flow of oil flows from the supply oil passage, a pressure loss caused by a spring is not generated while oil flows to the downstream side. Furthermore, the number of components can be reduced because a spring is not necessary, while the valve object can be made of a simple component.

According to an aspect of the present application, a valve timing controller includes the oil pressure control valve with the high valve-closing responsivity at a backflow time. Therefore, abnormal movement of the vane rotor caused by the cam torque can be restricted with reliability. Furthermore, the phase control responsivity of the valve timing controller can be improved, because the pressure loss is small in the oil pressure control valve at a forward flow time.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
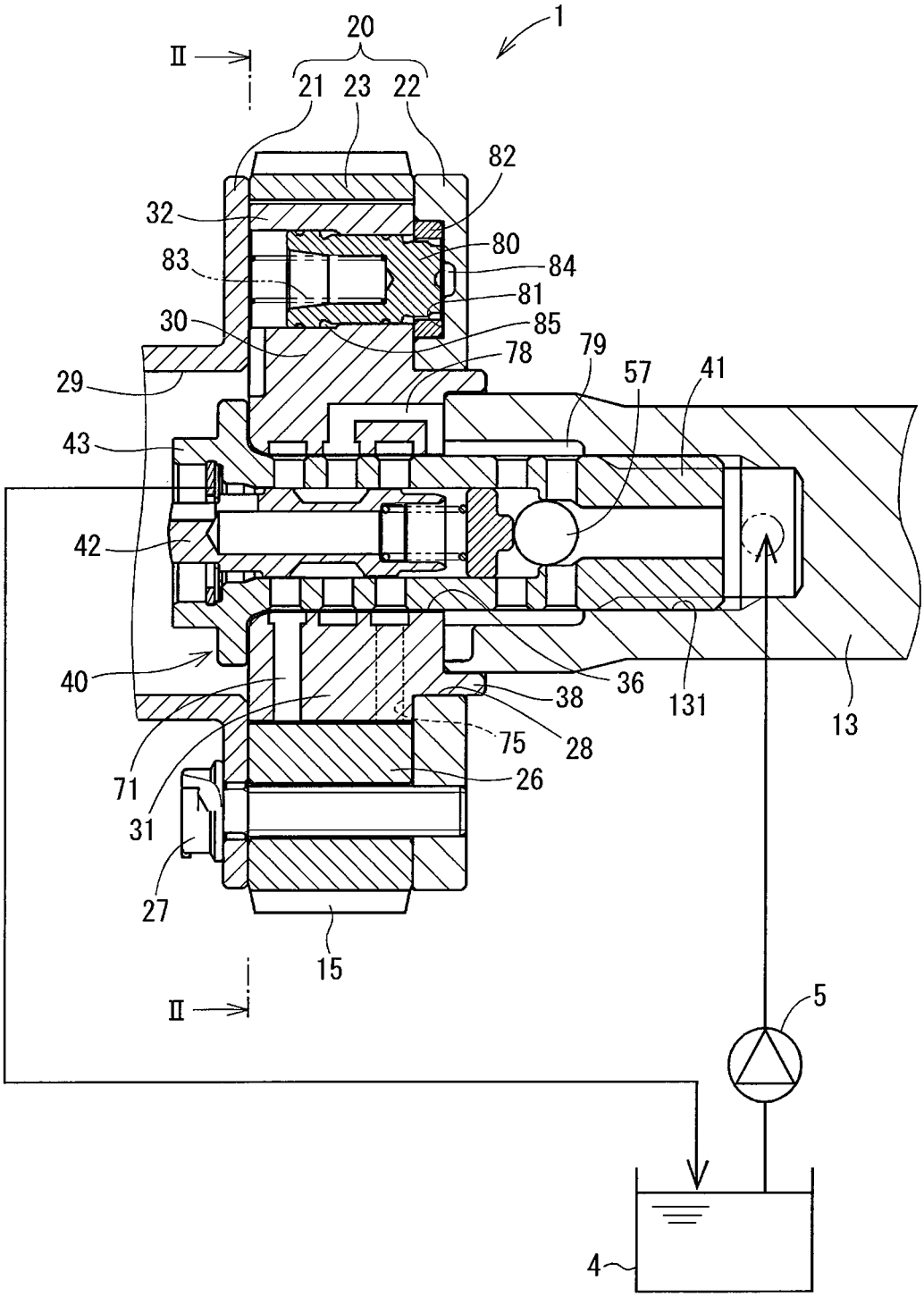
FIG. 1 is a sectional view illustrating a valve timing controller according to an embodiment.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

An embodiment is described with reference to FIGS. 1-6. A valve timing controller 1 is used for a driving force transfer mechanism of an internal combustion engine 2 shown in FIG. 3. A pulley 12 is fixed to a crankshaft 11 corresponding to a driving shaft of the engine 2. A pulley 15 is fixed to a camshaft 13 corresponding to a driven shaft, and a pulley 16 is fixed to a camshaft 14 corresponding to a driven shaft. A belt 17 is engaged around the pulleys 12, 15 and 16, and torque is transmitted to the camshafts 13 and 14 from the crankshaft 11. The camshaft 13 drives an intake valve 18, and the camshaft 14 drives an exhaust valve 19. The pulley 15 provided to a housing 20 is connected to the belt 17, and a vane rotor 30 is connected to the camshaft 13. The valve timing controller 1 controls the opening-and-closing timing of the intake valve 18 by rotating the crankshaft 11 and the camshaft 13 with a predetermined phase difference between the crankshaft 11 and the camshaft 13. The arrow direction shown in FIG. 3 represents a rotational direction of the belt 17.

Figure 2:
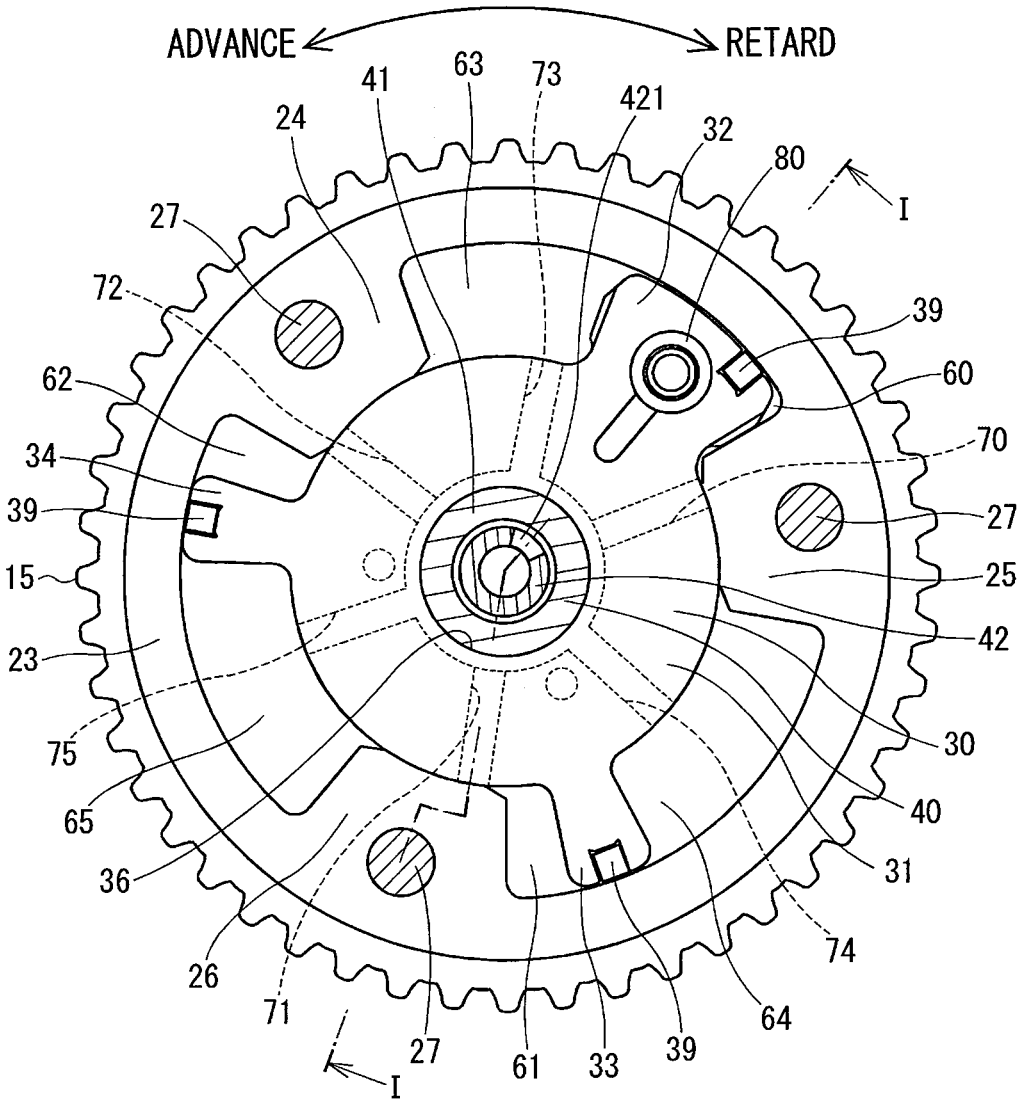
FIG. 2 is a cross-sectional view taken along a line II-II of FIG. 1.
Figure 3:
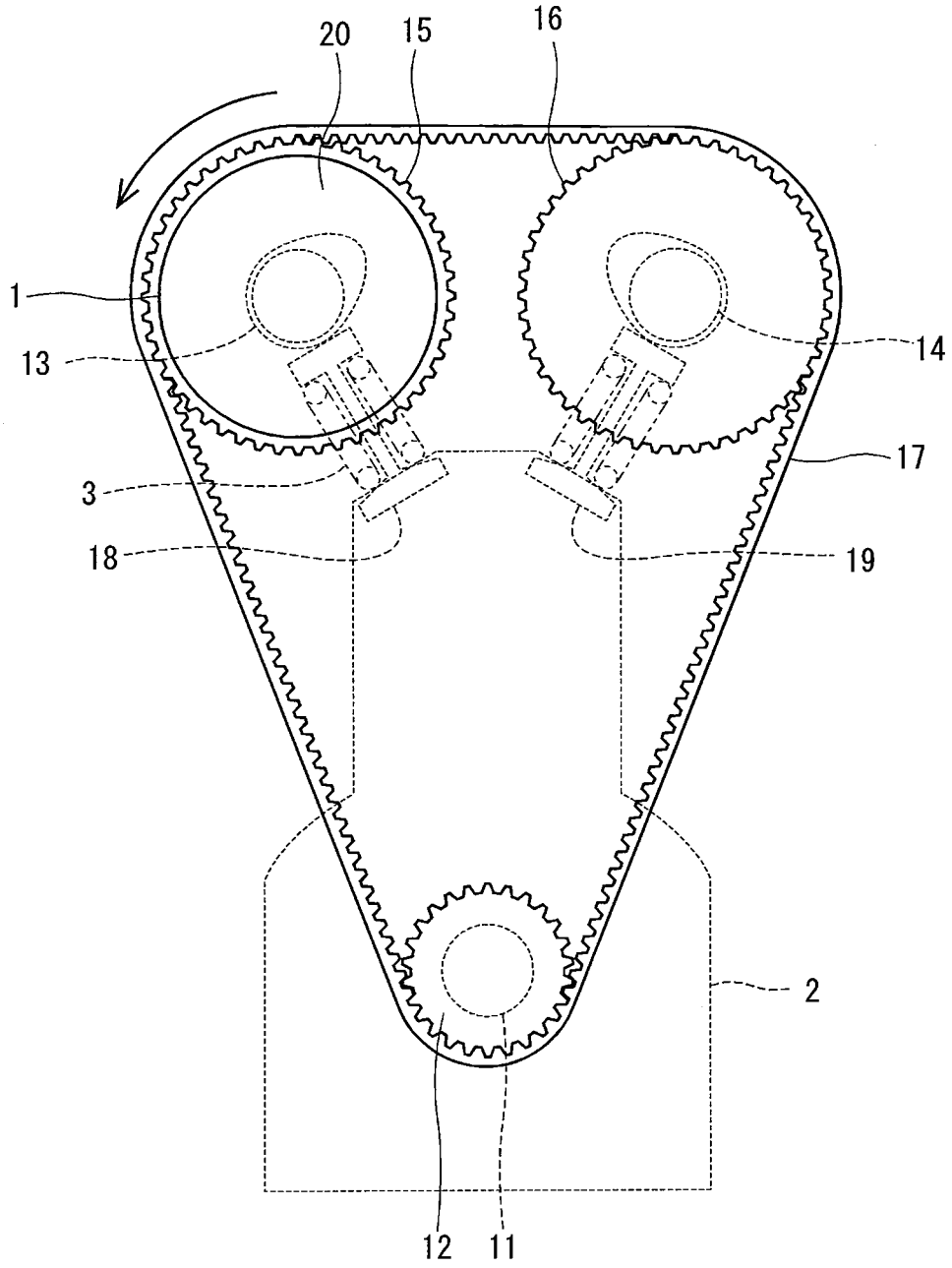
FIG. 3 is a schematic view illustrating a driving force transfer mechanism in which the valve timing controller is arranged.

As shown in FIG. 1 and FIG. 2, the valve timing controller 1 includes the housing 20, the vane rotor 30, and an oil pressure control valve 40. The housing 20 has a front plate 21, a rear plate 22, a pipe part 23, and shoes 24-26, which are connected with each other by a bolt 27. The front plate 21 having a circular shape and the rear plate 22 having a circular shape oppose to each other through the vane rotor 30. The front plate 21 has a front hole 29 in which a head 43 of the oil pressure control valve 40 is disposed. The rear plate 22 has a rear hole 28 in which a rear bushing 38 of the vane rotor 30 is disposed.

The pipe part 23 and the shoes 24-26 are integrally formed as one-piece component, and are interposed between the front plate 21 and the rear plate 22. The shoes 24-26 are arranged with a predetermined interval in the circumferential direction of the pipe part 23, and are projected inward in the radial direction from the pipe part 23. The sector-shaped oil pressure chamber is defined between the shoes adjacent to each other in the rotational direction. The belt 17 shown in FIG. 3 is wound around the pulley 15 provided to the perimeter of the pipe part 23, and the housing 20 rotates with the crankshaft 11.

As shown in FIG. 1 and FIG. 2, the vane rotor 30 is arranged to be able to rotate relative to the housing 20. The vane rotor 30 includes a rotor 31 having a cylindrical shape, vanes 32-34 projected outward in the radial direction from the rotor 31, and the rear bushing 38 extending from the rotor 31 in an axial direction. An outer wall of the rotor 31 located between the vanes 32-34 liquid-tightly slides in contact with the inner wall of the shoe 24-26 of the housing 20. The rotor 31 accommodates the oil pressure control valve 40 in the central hole 36 defined at the rotation central part. The rear bushing 38 is liquid-tightly fixed to the camshaft 13. The rear bushing 38 and the rear plate 22 are able to rotate relative to each other.

The vane 32-34 divides the oil pressure chamber of the housing 20 into an advance chamber 60-62 and a retard chamber 63-65. Oil pressure is supplied to or discharged from the advance chambers 60-62 through the advance oil passages 70-72. Oil pressure is supplied to or discharged from the retard chambers 63-65 through the retard oil passages 73-75.

A seal component 39 is formed at the radially outer wall of the vane 32-34. The seal component 39 regulates oil from flowing between the advance chambers 60-62 and the retard chambers 63-65. The vane rotor 30 is able to rotate relative to the housing 20 according to the oil pressure of the advance chambers 60-62 and the retard chambers 63-65. The arrow direction of advance shown in FIG. 2 represents an advance direction of the vane rotor 30 relative to the housing 20. The arrow direction of retard shown in FIG. 2 represents a retard direction of the vane rotor 30 relative to the housing 20.

A stopper piston 80 is accommodated in a hole defined in the vane rotor 30 so that the stopper piston 80 is able to reciprocate in the axial direction. A ring 82 is formed in a concave portion 81 defined in the rear plate 22, and the piston 80 is able to be fitted with the ring 82. The stopper piston 80 can be fitted into the ring 82 by the biasing force of the spring 83, when the vane rotor 30 is located at the maximum retard position to the housing 20. A first oil chamber 84 and a second oil chamber 85 are established in the circumference of the stopper piston 80. One of the first oil chamber 84 and the second oil chamber 85 communicates with the retard chamber 63, and the other of the first oil chamber 84 and the second oil chamber 85 communicates with the advance chamber 60. When the sum of the force of the oil pressure of the first oil chamber 84 applied to the stopper piston 80 and the force of the oil pressure of the second oil chamber 85 applied to the stopper piston 80 becomes larger than the biasing force of the spring 83, the stopper piston 80 is separated out of the ring 82.

The oil pressure control valve 40 includes a cylindrical sleeve 41, a spool 42 disposed inside the sleeve 41, and a ball valve 57. The ball valve 57 may correspond to a valve object. The sleeve 41 passes through the central hole 36 of the vane rotor 30, and is engaged with a female thread 131 defined in the camshaft 13. The head 43 of the sleeve 41 is in contact with the vane rotor 30. Thus, the camshaft 13, the vane rotor 30, and the sleeve 41 are fixed with each other. The vane rotor 30 and the camshaft 13 may correspond to an attachment component.

Figure 4:
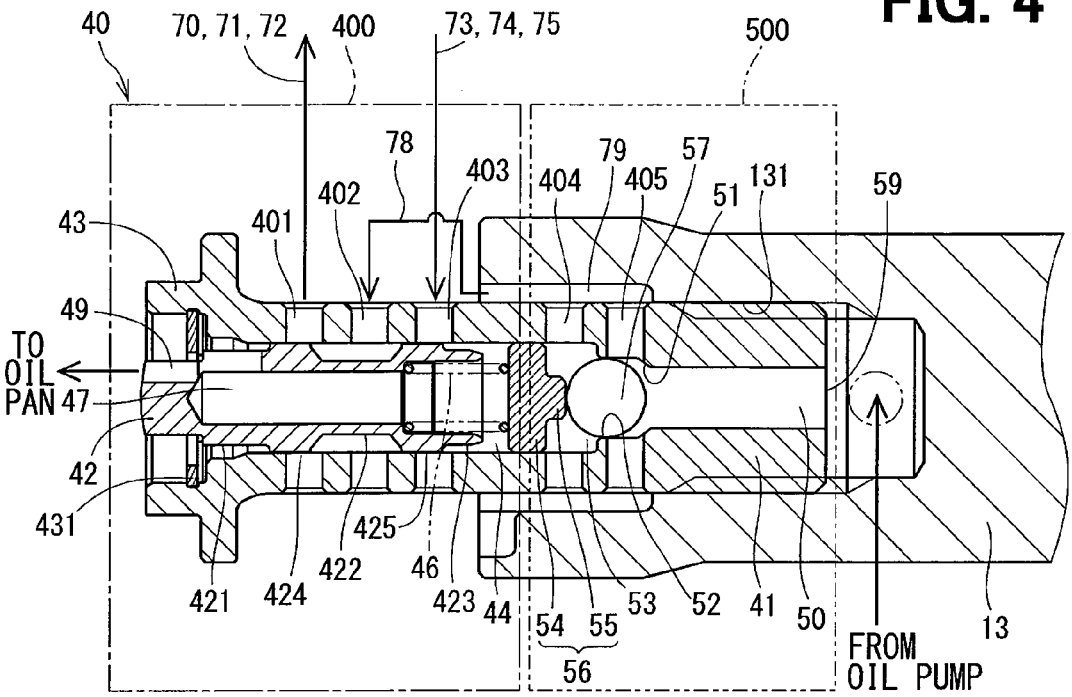
FIG. 4 is an enlarged view of an oil pressure control valve of the valve timing controller.
Figure 5:
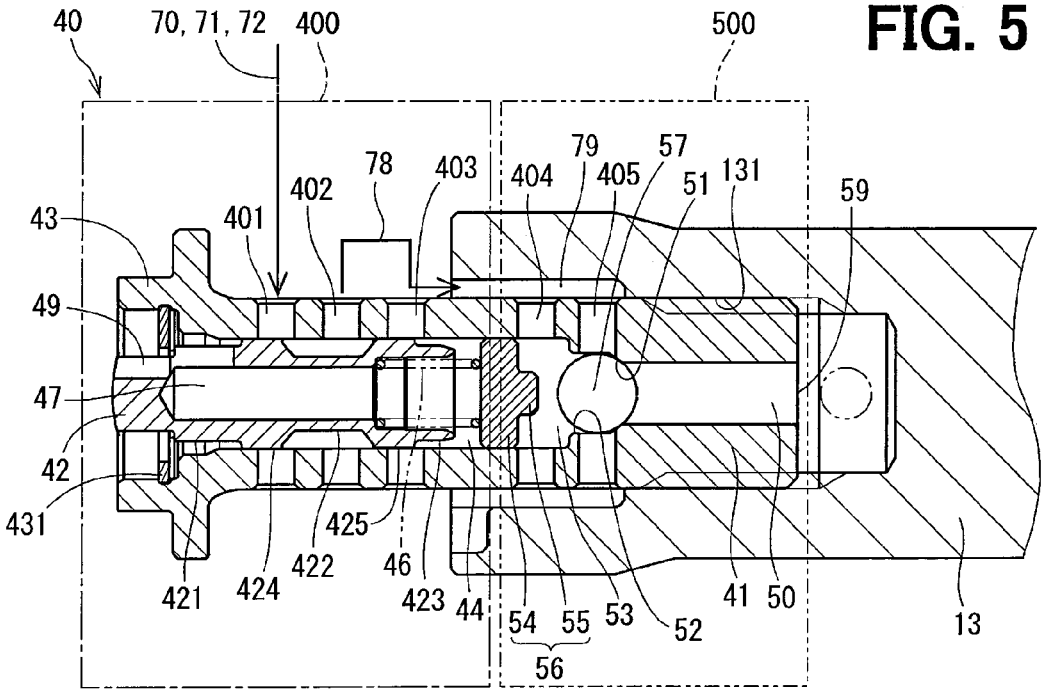
FIG. 5 is an enlarged view of the oil pressure control valve of the valve timing controller.

As shown in FIG. 4 and FIG. 5, the sleeve 41 has a first output port 401, an entrance port 402, a second output port 403, a backflow port 404, and a forward flow port 405 in this order from a side of the head 43. The first output port 401 communicates with the advance oil passages 70-72 of the vane rotor 30. The second output port 403 communicates with the retard oil passages 73-75 of the vane rotor 30. The entrance port 402 communicates with the forward flow port 405 and the backflow port 404 through the oil passages 78 and 79 defined in the vane rotor 30 and the camshaft 13.

The spool 42, the spring 46, the stopper 56, and the ball valve 57 are disposed at the radially inner side of the sleeve 41. The head side of the sleeve 41 divided by the stopper 56 functions as the passage change part 400, and the camshaft side of the sleeve 41 divided by the stopper 56 functions as the backflow restricting portion 500. In FIG. 4, the concept of the passage change part 400 is surrounded by a single chain line, and the concept of the backflow restricting portion 500*a* is surrounded by a double chain line. That is, the passage change part 400 and the backflow restricting portion 500 are arranged side by side in the axial direction of the oil pressure control valve 40. The passage change part 400 has the entrance port 402, the first output port 401, and the second output port 403, and the backflow restricting portion 500 has the forward flow port 405 and the backflow port 404.

The passage change part 400 is explained. The spool 42 is arranged in the accommodation chamber 44 defined inside the sleeve 41, and is able to reciprocate in the axial direction. A stopper ring 431 is disposed to the head 43 of the sleeve 41 to prevent the spool 42 from slipping out of the accommodation chamber 44.

The spool 42 has a front groove portion 421, a middle groove portion 422, and a rear groove portion 423 in this order from the head side, around the radially outer wall. The middle groove portion 422 always communicates with the entrance port 402. The front groove portion 421 is communicated with outside of the valve timing controller 1. The rear groove portion 423 is communicated with outside of the valve timing controller 1 through the inner passage 47 of the spool 42 and the front hole 49 of the spool 42.

A first land 424 is formed between the front groove portion 421 and the middle groove portion 422, and a second land 425 is formed between the middle groove portion 422 and the rear groove portion 423. The first land 424 and the second land 425 slide in contact with the inner wall of the spool 42.

A first end of the spring 46 is engaged with the stopper 56, and a second end of the spring 46 is engaged with the spool 42. The spring 46 biases the spool 42 toward the stopper ring that is opposite from the backflow restricting portion 500. A solenoid (not shown) is arranged at a position opposite from the camshaft, and reciprocates the spool 42 in the axial direction.

When the spool 42 is located at the position shown in FIG. 4 and FIG. 5, the first land 424 disconnects the first output port 401 and the front groove portion 421 from each other, and connects the first output port 401 and the middle groove portion 422 to communicate with each other. Moreover, the second land 425 disconnects the middle groove portion 422 and the second output port 403 from each other, and connects the second output port 403 and the rear groove portion 423 to communicate with each other. Thereby, the first output port 401 and the entrance port 402 communicate with each other through the middle groove portion 422, and the second output port 403 is communicated to outside of the valve timing controller 1.

On the other hand, although not illustrated, when the spool 42 moves toward the stopper 56, the first land 424 connects the first output port 401 and the front groove portion 42 to communicate with each other, and disconnects the first output port 401 and the middle groove portion 422 from each other. Moreover, the second land 425 connects the middle groove portion 422 and the second output port 403 to communicate with each other, and disconnects the second output port 403 and the rear groove portion 423 from each other. Thereby, the second output port 403 and the entrance port 402 communicate with each other through the middle groove portion 422, and the first output port 401 is communicated to outside of the valve timing controller 1. The stopper 56 regulates the maximum movement amount of the spool 42 toward the backflow restricting portion 500.

The backflow restricting portion 500 is explained. The sleeve 41 has the supply oil passage 50 inside, and the supply oil passage 50 has the feed port 59 at a position opposite from the passage change part 400 in the axial direction. The valve seat 51 is formed on the inner wall of the supply oil passage 50. A guide wall 52 is formed on an inner wall of the sleeve 41 located opposite from the feed port 59 through the valve seat 51. The guide wall 52 has a cylindrical shape having the same diameter continuing in the axial direction. The inside diameter of the guide wall 52 is slightly larger than the diameter of the ball valve 57. The ball valve 57 slides in contact with the guide wall 52, and is seated on or separated from the valve seat 51.

A pressure chamber 53 is formed at a position opposite from the supply oil passage 50 through the ball valve 57. That is, the pressure chamber 53 and the supply oil passage 50 are divided from each other by the ball valve 57. The stopper 56 is fixed, for example, by press-fitting between the pressure chamber 53 and the accommodation chamber 44 of the passage change part 400. The stopper 56 liquid-tightly separates the accommodation chamber 44 of the passage change part 400 and the pressure chamber 53 of the backflow restricting portion 500 from each other.

Figure 6:
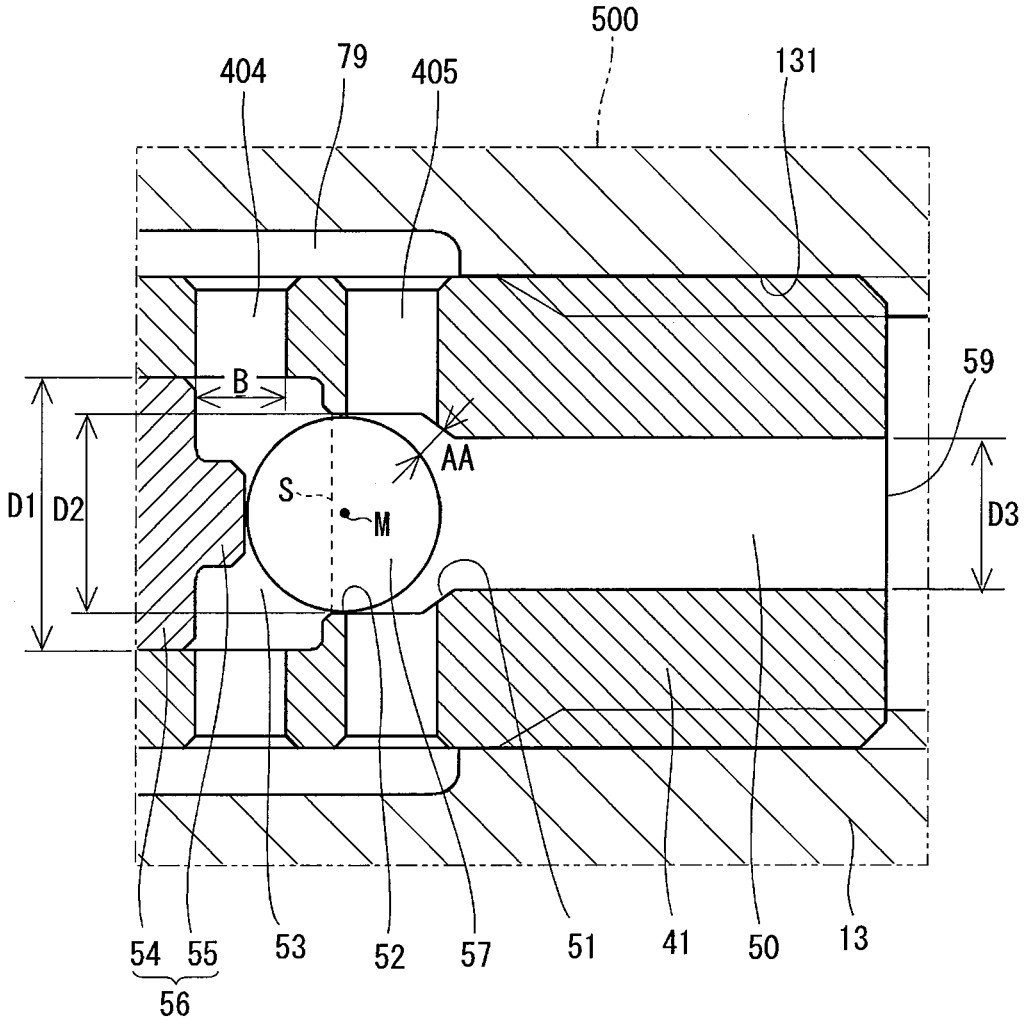
FIG. 6 is an enlarged view of a backflow restricting portion in FIG. 4.

The stopper 56 has a disk part 54 press-fitted in the inner wall of the sleeve 41, and a projection part 55 projected from the disk part 54 toward the ball valve 57. As shown in FIG. 6, when the ball valve 57 has the maximum lift amount (i.e., most distanced from the valve seat), the projection part 55 of the stopper 56 regulates the lift amount of the ball valve 57 so that the center M of the ball valve 57 is located between the valve seat 51 and the end surface S of the guide wall 52 adjacent to the stopper 56. That is, the projection part 55 of the stopper 56 regulates the maximum lift amount of the ball valve 57 at the position where the ball valve 57 and the guide wall 52 are maintained to be in contact with each other.

The forward flow port 405 extends from the guide wall 52 and the valve seat 51 outward in the radial direction, and connects the oil passage 79 defined in the camshaft 13 and the supply oil passage 50 to communicate with each other.

The backflow port 404 is located at a position further from the valve seat 51 than the forward flow port 405 is. The backflow port 404 always connects the oil passage 79 defined in the camshaft 13 and the pressure chamber 53 to communicate with each other.

As shown in FIG. 6, the ball valve 57 is located at a position where the ball valve 57 faces the forward flow port 405 in the state where the ball valve 57 is separated from the valve seat 51. Therefore, in this state, the passage area AA between the valve seat 51 and the ball valve 57 is smaller than the passage area B between the backflow port 404 and the pressure chamber 53.

Moreover, the inside diameter D1 of the sleeve 41 which forms the pressure chamber 53 is larger than the inside diameter D2, D3 of the sleeve 41 which forms the supply oil passage 50. Therefore, the volume of the pressure chamber 53 can be secured large and the fluid resistance of oil flowing to the ball valve 57 from the backflow port 404 can be reduced.

Accordingly, as shown in FIG. 4 and FIG. 6, when oil is supplied to the supply oil passage 50 from the feed port 59, the dynamic pressure of oil acts on the ball valve 57, and the ball valve 57 is separated from the valve seat 51. Therefore, oil flows from the supply oil passage 50 to the forward flow port 405, the oil passages 78 and 79, and the entrance port 402. At this time, oil flowing from the forward flow port 405 to the backflow port 404 via the oil passage 78, 79 does not affect or restrict the movement of the ball valve 57, because pressure loss arises at the connection place between the oil passage 79 and the backflow port 404 where the oil passage is bent (angled).

On the other hand, in case where the spring 3 (refer to FIG. 3) biasing the intake valve 18 in the valve-closing direction applies cam torque on the opposite direction opposite from the phase control direction of the valve timing controller 1, as shown in FIG. 5, an opposite flow of oil arises in an opposite direction opposite from the flow of the oil supplied to the supply oil passage 50. Due the backflow of the oil, oil is introduced into the backflow port 404 and the forward flow port 405 via the entrance port 402 and the oil passages 78 and 79 from the oil pressure chamber of the housing 20.

As mentioned above, in the state where the ball valve 57 is separated from the valve seat 51, the passage area AA between the valve seat 51 and the ball valve 57 is smaller than the passage area B between the backflow port 404 and the pressure chamber 53.

Therefore, in case where oil flows from the entrance port 402 through the oil passages 78 and 79 towards the forward flow port 405 and the backflow port 404, when oil flows from the forward flow port 405 into the supply oil passage 50 through the valve seat 51, the oil pressure is lowered according to the flow velocity at the position where the passage area AA is reduced between the ball valve 57 and the valve seat 51. Further, oil flowing from the backflow port 404 into the pressure chamber 53 through the passage area B larger than the passage area AA applies the dynamic pressure to the ball valve 57 toward the valve seat 51 (the valve-closing direction). Thereby, the oil pressure of the pressure chamber 53 instantaneously increases relative to the oil pressure of the supply oil passage 50, and the ball valve 57 is pressurized toward the valve seat 51.

Moreover, a clearance between the guide wall 52 and the ball valve 57 is set to allow the liquid-tightness to be kept such that a pressure difference is kept between the pressure chamber 53 and the throttled position, when the oil pressure is lowered according to the flow velocity at the throttled position where the passage area AA is decreased between the ball valve 57 and the valve seat 51. Moreover, the clearance is set to maintain the liquid-tightness such that oil pressure hardly leaks to the supply oil passage 50 while the dynamic pressure of oil flowing from the backflow port 404 into the pressure chamber 53 is applied to the ball valve 57 toward the valve seat 51 (in the valve-closing direction).

Therefore, when the cam torque acts on the opposite direction opposite from the phase control direction of the valve timing controller 1, the ball valve 57 is immediately seated on the valve seat 51, and the supply oil passage 50 is closed. Therefore, the backflow of oil is intercepted and unintentional movement of the vane rotor 30 caused by the cam torque is restricted.

Operation of the valve timing controller 1 is explained.

As shown in FIG. 1 and FIG. 2, when the engine 2 is in the stopped state, the stopper piston 80 enters inside the ring 82, and the phase of the vane rotor 30 relative to the housing 20 is maintained at the maximum retard position. Immediately after starting the engine 2, oil is not fully supplied to the retard chambers 63-65, the advance chambers 60-62, the first oil chamber 84, and the second oil chamber 85. The stopper piston 80 continues to fit into the ring 82. Therefore, sound of hitting between the housing 20 and the vane rotor 30 is not generated while the camshaft 13 receives torque fluctuations until oil is supplied to each oil pressure chamber.

After the engine 2 is started, when oil is fully supplied to each oil pressure chamber from the oil pump 5, the stopper piston 80 comes out of the ring 82 by the oil pressure of the first oil chamber 84 and the second oil chamber 85 against the biasing force of the spring 83. The vane rotor 30 can rotate relative to the housing 20.

When the valve timing controller 1 carries out an advance operation, the spool 42 of the oil pressure control valve 40 is located at the position shown in FIG. 1. Oil pumped by the oil pump 5 flows from the supply oil passage 50 through the forward flow port 405, the oil passages 78 and 79, the entrance port 402, the first output port 401, and the advance oil passages 70-72, and is supplied to the advance chambers 60-62. On the other hand, oil of the retard chambers 63-65 flows from the retard oil passages 73-75 through the second output port 403, the rear groove portion 423, and the inner passage 47, and is discharged outside of the valve timing controller 1 from the front hole 49. Thereby, the oil pressure of the advance chambers 60-62 acts on the vanes 32-34, and the vane rotor 30 rotates in the advance direction relative to the housing 20.

When the valve timing controller 1 carries out a retard operation, the spool 42 is pressed toward the stopper 56 by a solenoid (not shown). Oil pumped by the oil pump 5 flows from the supply oil passage 50 through the forward flow port 405, the oil passages 78 and 79, the entrance port 402, the second output port 403, and the retard oil passages 73-75, and is supplied to the retard chambers 63-65. On the other hand, oil of the advance chambers 60-62 flows from the advance oil passages 70-72 through the first output port 401, and is discharged outside of the valve timing controller 1 from the front groove portion 421. Thereby, the oil pressure of the retard chambers 63-65 acts on the vanes 32-34, and the vane rotor 30 rotates in the retard direction relative to the housing 20.

At the time of an advance operation and a retard operation, if a cam torque causes the vane rotor 30 to rotate in a direction opposite from the phase control direction, the ball valve 57 is seated on the valve seat 51 in the backflow restricting portion 500 of the oil pressure control valve 40, and the supply oil passage 50 is blockaded. Thereby, the vane rotor 30 is restricted from having abnormal movement.

When the vane rotor 30 reaches a target phase, the oil pressure control valve 40 regulates oil of the retard chambers 63-65 and the advance chambers 60-62 from being discharged to the oil pan 4. At this time, oil pressure is slightly supplied to the retard chambers 63-65 and the advance chambers 60-62 from the oil pump 5 through the retard oil passages 73-75 and the advance oil passages 70-72. Thereby, the vane rotor 30 is held at a target phase.

When an instruction to stop the engine is output in the operation of the valve timing controller 1, the vane rotor 30 rotates in the retard direction relative to the housing 20, similarly to the above-described retard operation, and stops at the maximum retard position. In this state, when the operation of the oil pump 5 stops and when the pressure of the first oil chamber 84 and the second oil chamber 85 declines, the stopper piston 80 is engaged inside the ring 82 by the biasing force of the spring 83. The engine 2 stops in this state.

According to the oil pressure control valve 40 of this embodiment, the ball valve 57 that is seated on or separated from the valve seat 51 slides in contact with the guide wall 52 defined by the inner wall of the sleeve 41. The forward flow port 405 extends to the oil passage 79 of the camshaft 13 from the guide wall 52. The forward flow port 405 is located between the backflow port 404 and the valve seat 51. The backflow port 404 always makes the pressure chamber 53 and the oil passage 79 of the camshaft 13 to communicate with each other. The pressure chamber 53 is located opposite from the supply oil passage 50 through the ball valve 57.

When a backflow arises from the oil passage 79 of the camshaft 13, the ball valve 57 is instantaneously seated on the valve seat 51 due to the dynamic pressure of oil introduced into the pressure chamber 53 from the backflow port 404 and the decrease in the pressure of oil flowing between the valve seat 51 and the ball valve 57 from the forward flow port 405. Therefore, the valve-closing responsivity can be raised relative to a backflow in the oil pressure control valve 40.

Moreover, the oil pressure control valve 40 is not equipped with a spring which biases the ball valve 57 to the valve seat 51. Therefore, when a forward flow of oil flows from the supply oil passage 50, the oil is able to flow into the oil passage 79 of the camshaft 13 without a pressure loss generated due to a spring.

Furthermore, the oil pressure control valve 40 uses the ball valve 57. Therefore, the durability can be improved with the simple-structured backflow restricting portion 500.

According to the embodiment, the ball valve 57 is located at a position where the ball valve 57 faces the forward flow port 405 in the state where the ball valve 57 is separated from the valve seat 51. In the oil pressure control valve 40 the passage area AA between the ball valve 57 and the valve seat 51 can be made smaller than the passage area B between the backflow port 404 and the pressure chamber 53. Therefore, when a backflow arises, the dynamic pressure applied to the ball valve 57 can be increased with the oil introduced into the pressure chamber 53 from the backflow port 404. Further, in the oil pressure control valve 40, the pressure of the oil which flows between the valve seat 51 and the ball valve 57 from the forward flow port 405 can be reduced.

According to the embodiment, the passage area AA between the ball valve 57 and the valve seat 51 is smaller than the passage area B between the backflow port 404 and the pressure chamber 53 in the state where the ball valve 57 is separated from the valve seat 51. When a backflow arises, the oil pressure control valve 40 can reduce the pressure of the oil which flows from the forward flow port 405 between the valve seat 51 and the ball valve 57 while the dynamic pressure which acts on the ball valve 57 is increased by the oil introduced into the pressure chamber 53 from the backflow port 404.

According to the embodiment, the inside diameter D1 of the sleeve 41 which forms the pressure chamber 53 is larger than the inside diameter D2, D3 of the sleeve 41 which forms the supply oil passage 50. Therefore, the volume of the pressure chamber 53 can be increased, and the axial length can be reduced in the pressure chamber 53. Moreover, it is possible to reduce the fluid resistance of oil which flows into the pressure chamber 53 from the backflow port 404.

According to the embodiment, in the state where the ball valve 57 is separated from the valve seat 51, the stopper 56 regulates the movement amount of the ball valve 57 such that the ball valve 57 is located at a position where the ball valve 57 faces the forward flow port 405 and where the ball valve 57 and the guide wall 52 slide in contact with each other. Thereby, when a backflow arises, the pressure of oil which flows from the forward flow port 405 between the valve seat 51 and the ball valve 57 is lowered. Further, the dynamic pressure of oil flowing from the backflow port 404 into the pressure chamber 53 to affect the ball valve 57 to move toward the valve seat 51 in the valve-closing direction is restricted from leaking to the supply oil passage 50. Therefore, the oil pressure control valve 40 can improve the valve-closing responsivity.

According to the embodiment, the stopper 56 has the disk part 54 press-fitted in the inner wall of the sleeve 41, and the projection part 55 projected from the disk part 54 toward the ball valve 57. When the ball valve 57 has the maximum lift amount (leftward in FIG. 6), the projection part 55 regulates the lift amount of the ball valve 57 so that the center M of the ball valve 57 is located between the valve seat 51 and the end surface S of the guide wall 52 adjacent to the stopper 56. Thereby, the volume of the pressure chamber 53 can be increased while the projection part 55 is projected into the pressure chamber 53. Furthermore, the dynamic pressure acting to the ball valve 57 from the oil of the pressure chamber 53 can be increased by making only the projection part 55 to be in contact with the ball valve 57.

According to the embodiment, the sleeve 41 has the backflow restricting portion 500 and the passage change part 400. The backflow restricting portion 500 has the forward flow port 405 and the backflow port 404. The passage change part 400 has the entrance port 402, the first output port 401, and the second output port 403. Thereby, the backflow restricting portion 500 and the passage change part 400 can be one-piece component in the oil pressure control valve 40.

According to the embodiment, the stopper 56 is fixed to the inner wall of the sleeve 41 and keeps the liquid-tightness between the passage change part 400 and the backflow restricting portion 500. Thereby, when a backflow arises, the oil pressure of the pressure chamber 53 is restricted from leaking toward the passage change part 400. Therefore, the oil pressure control valve 40 can improve the valve-closing responsivity.

According to the embodiment, the stopper 56 is in contact with the spring 46 which biases the spool 42, and regulates the movement amount of the spool 42 toward the backflow restricting portion 500. The single stopper 56 has three functions, such as a function to engage with the spring 46, a function to regulate the movement amount of the spool 42, and a function to regulate the movement amount of the ball valve 57. Therefore, the oil pressure control valve 40 can be downsized, and it is possible to reduce the number of components for producing the oil pressure control valve 40.

According to the embodiment, the valve timing controller 1 is equipped with the oil pressure control valve 40 having the high valve-closing responsivity at a backflow time. Thus, the abnormal movement of the vane rotor 30 caused by cam torque can be restricted with reliability. Moreover, the phase control responsivity of the valve timing controller 1 can be improved due to the oil pressure control valve 40 in which the pressure loss is small in a forward flow of oil.

The valve timing controller of the embodiment controls the opening-and-closing timing of an intake valve. Alternatively, in other embodiment, the valve timing controller may control the opening-and-closing timing of an exhaust valve.

In the embodiment, the first output port of the oil pressure control valve 40 communicates with the advance oil passage, and the second output port of the oil pressure control valve 40 communicates with the retard oil passage. Alternatively, in other embodiment, the first output port may communicate with the retard oil passage, and the second output port may communicate with the advance oil passages 70-72.

In the embodiment, the oil pressure control valve 40 is located at the rotational central part of a vane rotor and a camshaft. Alternatively, in other embodiment, the oil pressure control valve 40 may be placed at, for example, an engine block that is distant from the valve timing controller. In this case, the engine block to which the oil pressure control valve 40 is attached has an oil passage communicating with the forward flow port 405 and the backflow port 404 of the oil pressure control valve 40. In this case, an engine block may correspond to an attachment component.

The oil pressure control valve 40 has the ball valve 57 in the embodiment. Alternatively, in other embodiment, a valve object of the oil pressure control valve 40 may be other component having different shape such as a needle valve.

Such changes and modifications are to be understood as being within the scope of the present disclosure as defined by the appended claims.

What is claimed is:

1. An oil pressure control valve to be attached to an attachment component having an oil passage, the oil pressure control valve comprising:

a sleeve having a cylindrical shape, a supply oil passage being defined in the sleeve and communicating to a feed port to which oil is supplied;

a valve object that is able to be seated on or separated from a valve seat defined on an inner wall of the supply oil passage;

a guide wall defined by an inner wall of the sleeve, the valve object being able to slidingly move in contact with the guide wall, the valve seat being located between the feed port and the guide wall;

a forward flow port extending from the guide wall to the oil passage of the attachment component;

a pressure chamber defined in the sleeve, the valve seat being located between the supply oil passage and the pressure chamber; and a backflow port that always allows the pressure chamber and the oil passage of the attachment component to communicate with each other, wherein the forward flow port is located between the valve seat and the backflow port.

2. The oil pressure control valve according to claim 1, wherein the valve object is located at a place where the valve object faces the forward flow port in a state where the valve object is separated from the valve seat.

3. The oil pressure control valve according to claim 1, wherein a passage area defined between the valve object and the valve seat is smaller than a passage area defined between the backflow port and the pressure chamber in a state where the valve object is separated from the valve seat.

4. The oil pressure control valve according to claim 1, wherein the sleeve that defines the pressure chamber has a first inside diameter, the sleeve that defines the supply oil passage has a second inside diameter, and the first inside diameter is larger than the second inside diameter.

5. The oil pressure control valve according to claim 1, further comprising:

a stopper that regulates a movable amount of the valve object, wherein the stopper restricts the valve object at a position where the valve object faces the forward flow port and where the valve object is kept to be in contact with the guide wall, in a state where the valve object is separated from the valve seat.

6. The oil pressure control valve according to claim 5, wherein the valve object has a ball valve, the stopper has a disk part press-fitted into the inner wall of the sleeve, and a projection part projected from the disk part toward the valve object, and the projection part regulates a lift amount of the valve object so that a center of the valve object is located between the valve seat and an end surface of the guide wall when the valve object has a maximum lift amount.

7. The oil pressure control valve according to claim 5, wherein the sleeve includes a backflow restricting portion having the forward flow port and the backflow port, and a passage change part having an entrance port communicated with the forward flow port and the backflow port through the oil passage of the attachment component, and an output port.

8. The oil pressure control valve according to claim 7, wherein the stopper is fixed to the inner wall of the sleeve so as to keep liquid-tightness between the passage change part and the backflow restricting portion.

9. The oil pressure control valve according to claim 7, further comprising:

a spool disposed in an accommodation chamber defined in the passage change part of the sleeve, the spool connecting the entrance port and the output port to communicate with each other or disconnecting the entrance port and the output port from each other, and a spring having a first end engaged with the stopper and a second end engaged with the spool, the spring biasing the spool away from the backflow restricting portion, wherein the stopper is in contact with the spring and regulates a movement amount of the spool toward the backflow restricting portion.

10. A valve timing controller that controls opening-and-closing timing of an intake valve or an exhaust valve by changing a relative rotation phase of a driving shaft and a driven shaft of an internal combustion engine, the intake valve or the exhaust valve being driven by the driven shaft, the valve timing controller comprising:

a housing that rotates with one of the driving shaft and the driven shaft;

a vane rotor that rotates with the other of the driving shaft and the driven shaft, the vane rotor partitioning an oil pressure chamber defined in the housing into an advance chamber and a retard chamber, the vane rotor rotating relative the housing according to an oil pressure of the advance chamber and the retard chamber;

the oil pressure control valve according to claim 7, the oil pressure control valve being located at a rotational central part of the vane rotor or the driven shaft; and an advance oil passage or a retard oil passage that connects the advance chamber or the retard chamber to the output port, wherein the oil passage of the attachment component connects the forward flow port, the backflow port, and the entrance port to communicate with each other.

* * * * *